US010029464B2

(12) United States Patent
Ghozeil et al.

(10) Patent No.: US 10,029,464 B2
(45) **Date of Patent: *Jul. 24, 2018**

(54) FLUID EJECTION APPARATUS WITH SINGLE POWER SUPPLY CONNECTOR

(71) Applicant: HEWLETT-PACKARD DEVELOPMENT COMPANY, L.P., Houston, TX (US)

(72) Inventors: Adam L. Ghozeil, Corvallis, OR (US); David Maxfield, Philomath, OR (US); Peter James Fricke, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/706,315

(22) Filed: Sep. 15, 2017

(65) Prior Publication Data

US 2018/0001634 A1 Jan. 4, 2018

Related U.S. Application Data

(63) Continuation of application No. 15/039,374, filed as application No. PCT/US2013/072274 on Nov. 27, 2013, now Pat. No. 9,796,181.

(51) Int. Cl.
*B41J 2/14* (2006.01)
*B41J 2/045* (2006.01)

(52) U.S. Cl.
CPC ..... *B41J 2/1433* (2013.01); *B41J 2/0458* (2013.01); *B41J 2/04541* (2013.01); *B41J 2/14072* (2013.01); *B41J 2002/14491* (2013.01)

(58) Field of Classification Search
CPC .... B41J 2/1433; B41J 2/04541; B41J 2/0458; B41J 2/14072; B41J 2002/14491
See application file for complete search history.

(56) References Cited

U.S. PATENT DOCUMENTS

| | | | |
|---|---|---|---|
| 6,328,407 | B1 | 12/2001 | Sengun |
| 6,398,331 | B1 | 6/2002 | Asaka et al. |
| 6,787,050 | B2 | 9/2004 | Parish |
| 7,036,898 | B2 | 5/2006 | Edelen et al. |
| 7,344,227 | B2 | 3/2008 | King et al. |

(Continued)

FOREIGN PATENT DOCUMENTS

| | | |
|---|---|---|
| JP | 2003200574 | 7/2003 |
| JP | 2006326972 | 12/2006 |

(Continued)

OTHER PUBLICATIONS

Lee, M.J.E. et al; "Low-Power Area-Efficient High-Speed I/O Circuit Techniques"; Nov. 2000; vol. 35; Issue 11; http://ieeexplore.ieee.org/xpl/login.jsp?tp=arnumber=881204 &url=http%3A%2F%2Fieeexplore.ieee.org%2Fxpls%2Fabs_all.jsp%3Farnumber%3D881204.

*Primary Examiner* — Geoffrey Mruk
(74) *Attorney, Agent, or Firm* — Fabian VanCott

(57) ABSTRACT

An example provides a fluid ejection apparatus including a fluid feed slot along a length of a print head die of the fluid ejection apparatus to supply a fluid to a plurality of drop ejectors, control circuitry adjacent to at least one side of the fluid feed slot to control ejection of drops of fluid from the plurality of drop ejectors, and a single power supply connector at an end of the print head die to supply power to the control circuitry.

20 Claims, 5 Drawing Sheets

(56) References Cited

U.S. PATENT DOCUMENTS

| | | | |
|---|---|---|---|
| 8,399,298 | B2 | 3/2013 | Wu |
| 8,444,255 | B2 | 5/2013 | Bakker et al. |
| 9,796,181 | B2 * | 10/2017 | Ghozeil ..... B41J 2/04541 |
| 2003/0001915 | A1 | 1/2003 | Askeland et al. |
| 2005/0088465 | A1 | 4/2005 | Parish et al. |
| 2006/0125881 | A1 | 6/2006 | Kousuke et al. |
| 2009/0174753 | A1 | 7/2009 | Kurokawa et al. |
| 2011/0292112 | A1 | 12/2011 | Oohashi et al. |

FOREIGN PATENT DOCUMENTS

| | | | |
|---|---|---|---|
| JP | 2008044310 | | 2/2008 |
| JP | 2008-137276 | | 6/2008 |
| JP | 2009298107 | | 12/2009 |
| JP | 2010076433 | A | 4/2010 |
| JP | 2011-251415 | | 12/2011 |
| JP | 2012011777 | | 1/2012 |
| JP | 2013-116612 | | 6/2013 |
| KR | 2008-0099017 | | 11/2008 |

* cited by examiner

FLUID EJECTION APPARATUS WITH SINGLE POWER SUPPLY CONNECTOR

CROSS-REFERENCE TO RELATED APPLICATIONS

This application is a continuation of U.S. application Ser. No. 15/039,374 filed May 25, 2016 which issued as U.S. Pat. No. 9,796,181 on Oct. 24, 2017, which is incorporated herein by reference in its entirety.

BACKGROUND

Inkjet printing systems and replaceable printer components, such as some inkjet print head assemblies, commonly include a print head die having a number of nozzles to eject ink onto a print medium. The print head die may include an electrical interface for signal and power connections for controlling the operation of nozzles of the print head die. Although print head die sizes continue to shrink, the extent to which a print head die may be reduced in size may be limited by the area needed for providing electrical signal and power connections to the print head.

BRIEF DESCRIPTION OF THE DRAWINGS

The Detailed Description section references, by way of example, the accompanying drawings, all in which various embodiments may be implemented.

Certain examples are shown in the above-identified drawings and described in detail below. The drawings are not necessarily to scale, and various features and views of the drawings may be shown exaggerated in scale or in schematic for clarity and/or conciseness.

DETAILED DESCRIPTION

Device features continue to decrease in size. Print heads, for instance, may realize improved print quality as the number of nozzles increase. Devices that incorporate micro-and-smaller-electrical-mechanical-systems (generally referred to herein as "MEMS") devices, by definition, are very small and continue to serve a broad range of applications in a broad range of industries.

Fabrication of small device features cost-effectively and with high performance and reliability, however, may be a challenge. Continuing with the print head example, an increased number of nozzles and/or decreased print head size. For some inkjet print heads, a primary geometric tuning parameter for cost may be the width of the print head die as the length of the die may be fixed by the desired print swath. The width of the print head die, however, may be limited by control circuits and fluidic routing, and even when these constraints have been addressed a remaining constraint may be the width needed for providing electrical signal and power connections to the print head. Though reduction of the size of the bond pads may be one approach to addressing the bond pad constraint, this solution may result in unacceptable control requirements for the bonder. Similarly, multiple rows of staggered bond pads may be possible, but this solution may require wire bond technology rather than the high-throughput thermally activated bonding (TAB) technology commonly used to attach flex circuits to the print head die.

Described herein are various implementations of a fluid ejection apparatus including a fluid feed slot along a length of a print head die of the fluid ejection apparatus to supply a fluid to a plurality of drop ejectors, control circuitry adjacent to at least one side of the fluid feed slot to control ejection of drops of fluid from the plurality of drop ejectors, and a single power supply connector at a first end of the print head die to supply power to the control circuitry. The print head die may include a ground connector at a second end, opposite the first end, of the print head die to connect the control circuitry to ground. In various implementations, the print head die width may be narrowed by eliminating power connectors at the second end of the print head die, as compared to configurations in which a power connector is located at each end of the print head die. Instead, various implementations include the single power supply connector for the entire print head. In various implementations, the ground connector may be a single ground connector, with ground connectors on the first end eliminated to further allow the print head die to be narrowed.

Figure 1:
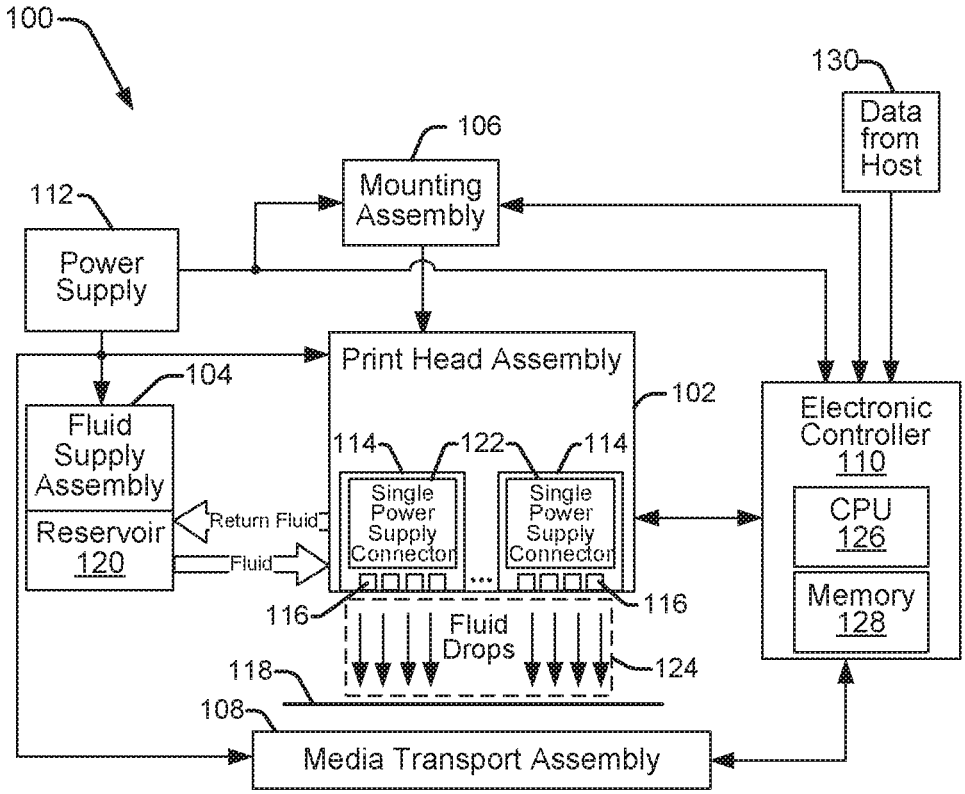
FIG. 1 is a block diagram of an example fluid ejection system.

FIG. 1 illustrates an example fluid ejection system 100 suitable for incorporating a fluid ejection apparatus comprising a single power supply connector as described herein. In various implementations, the fluid ejection system 100 may comprise an inkjet printer or printing system. The fluid ejection system 100 may include a print head assembly 102, a fluid supply assembly 104, a mounting assembly 106, a media transport assembly 108, an electronic controller 110, and at least one power supply 112 that may provide power to the various electrical components of fluid ejection system 100.

The print head assembly 102 may include at least one print head 114. The print head 114 may comprise a print head die having a fluid feed slot along a length of a print head die to supply a fluid, such as ink, for example, to a plurality of drop ejectors 116, such as orifices or nozzles, for example. The print head die may further include control circuitry adjacent to at least one side of the fluid feed slot to control ejection of drops of fluid from the plurality of drop ejectors 116, a single power supply connector 122 at a first end of the print head die to supply power to the control circuitry, and a ground connector at a second end, opposite the first end, of the print head die to connect the control circuitry to ground. The plurality of drop ejectors 116 may eject ejects drops of the fluid toward a print media 118 so as to print onto the print media 118. The print media 118 may be any type of suitable sheet or roll material, such as, for example, paper, card stock, transparencies, polyester, plywood, foam board, fabric, canvas, and the like. The drop ejectors 116 may be arranged in one or more columns or arrays such that properly sequenced ejection of fluid from drop ejectors 116 may cause characters, symbols, and/or other graphics or images to be printed on the print media 118 as the print head assembly 102 and print media 118 are moved relative to each other.

The fluid supply assembly 104 may supply fluid to the print head assembly 102 and may include a reservoir 120 for storing the fluid. In general, fluid may flow from the reservoir 120 to the print head assembly 102, and the fluid supply assembly 104 and the print head assembly 102 may form a one-way fluid delivery system or a recirculating fluid delivery system. In a one-way fluid delivery system, substantially all of the fluid supplied to the print head assembly 102 may be consumed during printing. In a recirculating fluid delivery system, however, only a portion of the fluid supplied to the print head assembly 102 may be consumed during printing. Fluid not consumed during printing may be returned to the fluid supply assembly 104. The reservoir 120 of the fluid supply assembly 104 may be removed, replaced, and/or refilled.

The mounting assembly 106 may position the print head assembly 102 relative to the media transport assembly 108, and the media transport assembly 108 may position the print media 118 relative to the print head assembly 102. In this configuration, a print zone 124 may be defined adjacent to the drop ejectors 116 in an area between the print head assembly 102 and print media 118. In some implementations, the print head assembly 102 is a scanning type print head assembly. As such, the mounting assembly 106 may include a carriage for moving the print head assembly 102 relative to the media transport assembly 108 to scan the print media 118. In other implementations, the print head assembly 102 is a non-scanning type print head assembly. As such, the mounting assembly 106 may fix the print head assembly 102 at a prescribed position relative to the media transport assembly 108. Thus, the media transport assembly 108 may position the print media 118 relative to the print head assembly 102.

The electronic controller 110 may include a processor (CPU) 126, memory 128, firmware, software, and other electronics for communicating with and controlling the print head assembly 102, mounting assembly 106, and media transport assembly 108. Memory 128 may include both volatile (e.g., RAM) and nonvolatile (e.g., ROM, hard disk, floppy disk, CD-ROM, etc.) memory components comprising computer/processor-readable media that provide for the storage of computer/processor-executable coded instructions, data structures, program modules, and other data for the printing system 100. The electronic controller 110 may receive data 130 from a host system, such as a computer, and temporarily store the data 130 in memory 128. Typically, the data 130 may be sent to the printing system 100 along an electronic, infrared, optical, or other information transfer path. The data 130 may represent, for example, a document and/or file to be printed. As such, the data 130 may form a print job for the printing system 100 and may include one or more print job commands and/or command parameters.

In various implementations, the electronic controller 110 may control the print head assembly 102 for ejection of fluid drops from the drop ejectors 116. Thus, the electronic controller 110 may define a pattern of ejected fluid drops that form characters, symbols, and/or other graphics or images on the print media 118. The pattern of ejected fluid drops may be determined by the print job commands and/or command parameters from the data 130.

In various implementations, the printing system 100 is a drop-on-demand thermal inkjet printing system with a thermal inkjet (TIJ) print head 114 suitable for implementing a print head die having a single power supply connector 122 as described herein. In some implementations, the print head assembly 102 may include a single TIJ print head 114. In other implementations, the print head assembly 102 may include a wide array of TIJ print heads 114. While the fabrication processes associated with TIJ print heads are well suited to the integration of the print head dies described herein, other print head types such as a piezoelectric print head can also implement a print head die having a single power supply connector 122.

Figure 2:
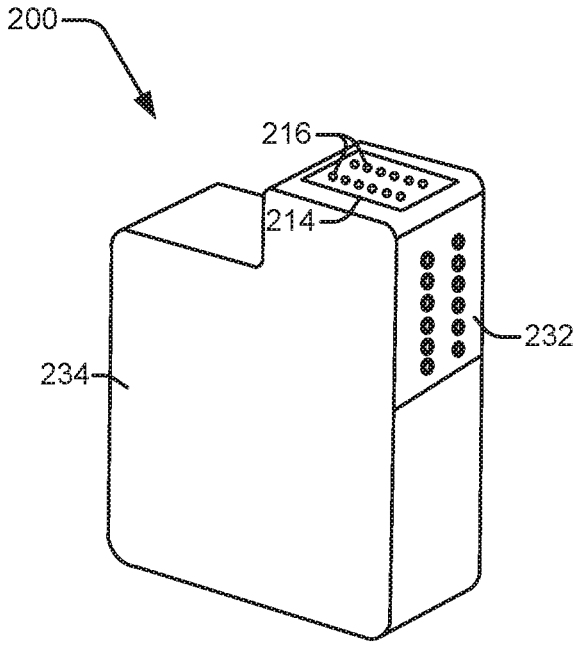
FIG. 2 is a perspective view of an example fluid ejection cartridge.

In various implementations, the print head assembly 102, fluid supply assembly 104, and reservoir 120 may be housed together in a replaceable device such as an integrated print head cartridge. FIG. 2 is a perspective view of an example inkjet cartridge 200 that may include the print head assembly 102, ink supply assembly 104, and reservoir 120, according to an implementation of the disclosure. In addition to one or more print heads 214, inkjet cartridge 200 may include electrical contacts 232 and an ink (or other fluid) supply chamber 234. In some implementations, the cartridge 200 may have a supply chamber 234 that stores one color of ink, and in other implementations it may have a number of chambers 234 that each store a different color of ink. The electrical contacts 232 may carry electrical signals to and from controller (such as, for example, the electrical controller 110 described herein with reference to FIG. 1) and power (from the power supply 112, for example) to cause the ejection of ink drops through drop ejectors 216 and single-side thermal sensing of the print head 214.

Figure 3:
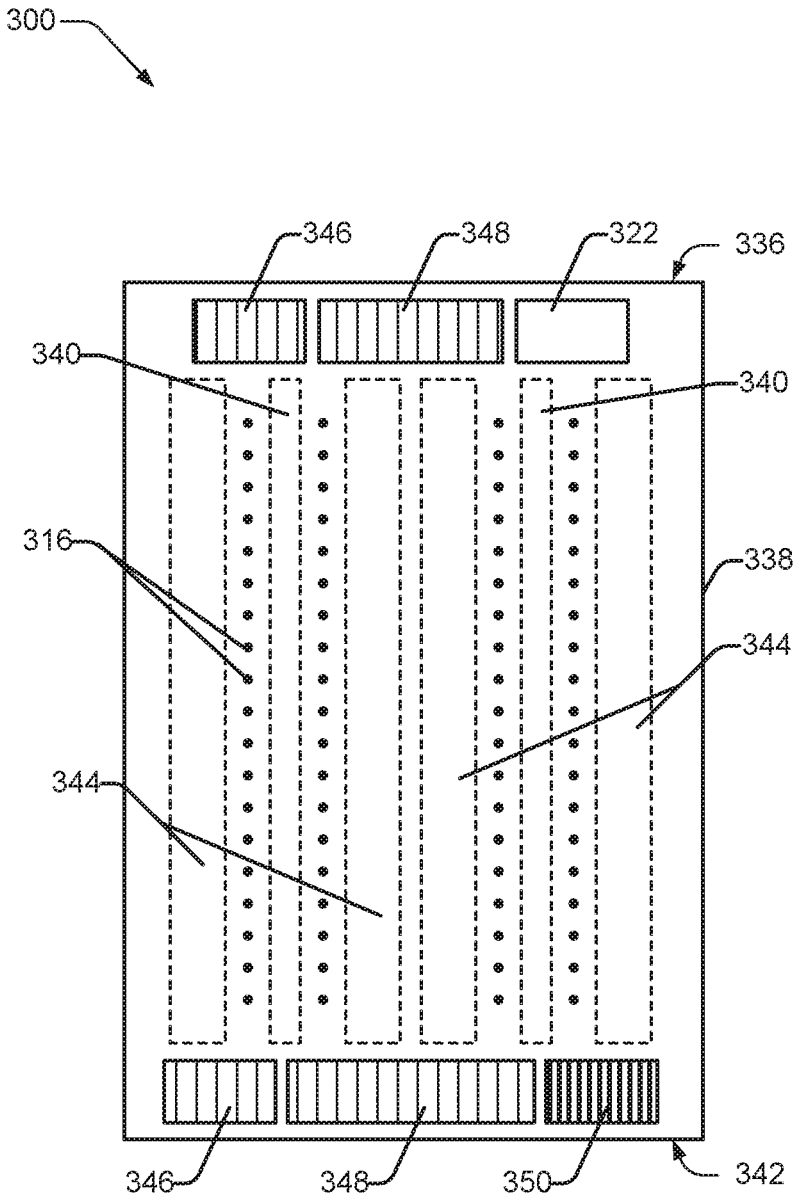
FIG. 3 is a top view of an example fluid ejection apparatus having a print head die with a single power supply connector.

FIG. 3 illustrates a top view of an example fluid ejection apparatus 300 having a single power supply connector 322 at a first end 336 of a print head die/substrate 338. In various implementations, the fluid ejection apparatus 300 may comprise, at least in part, a print head or print head assembly. In some implementations, for example, the fluid ejection apparatus 300 may be an inkjet print head or inkjet printing assembly. As used herein, the term "connector" may comprise a bond pad, a contact pad, or the like.

As illustrated, the fluid ejection apparatus 300 has a plurality of fluid feed slots 340 (underlying layer shown in hashed line) in the print head die 338, extending in parallel along the length of the print head die 338 between the first end 336 and second end 342 of the print head die 338. In other implementations, the fluid ejection apparatus 300 may include more than the two fluid feed slots 340 illustrated. In still other implementations, the fluid ejection apparatus 300 may include a single fluid feed slot 340.

Each of the fluid feed slots 340 may be configured to supply a fluid to a corresponding plurality of fluid drop ejectors 316. In various implementations and as illustrated, the plurality of drop ejectors 316 may comprise a plurality of columns of the drop ejectors 316. It is noted that although the illustrated example depicts two columns of drop ejectors 316 per fluid feed slot 340, many implementations may include fewer or more columns and/or columns with more or fewer drop ejectors 316 than shown. Though not illustrated, the fluid ejection apparatus 300 may further include a plurality of actuators, with an actuator proximate to each fluid ejector 316 to cause fluid to be ejected through a corresponding one of the drop ejectors 316. In some implementations, the actuators may comprise resistive or heating elements. In some implementations, the actuators comprise split resistors or single rectangular resistors. Other types of actuators such as, for example, piezoelectric actuators or other actuators may be used for the actuators in other implementations.

The print head die 338 may include control circuitry 344 (regions including the control circuitry 344 are generally shown by hashed lines) adjacent to at least one side of each of the fluid feed slots 340 to control ejection of drops of fluid from the plurality of drop ejectors 316. In other implementations, the print head die 338 may include control circuitry 344 adjacent to only one side of each of the fluid feed slots 340. In various implementations, the control circuitry 344 may comprise logic for controlling individual ones or sets of the drop ejectors 316. In various ones of these implementations, for example, the control circuitry 344 may comprise transistors, address lines, etc. for controlling individual ones or sets of the drop ejectors 316.

As noted herein, the print head die 338 may comprise a single power supply connector 322 at the first end 336 of the print head die 338 to supply power to the control circuitry 344 such that the second end 342 is devoid of power supply connectors. By eliminating power supply connectors on the second end 342 and using the single power supply connector 322 to supply logic power for the entire print head die 338, the overall width of the print head die 338 may be reduced as compared to configurations including power supply connectors on the first end 336 and the second end 342. In some implementations, power supply fidelity may be maintained by widening the on-print head die 338 routing, but in these implementations, the width of the print head die 338 may be increased, if at all, less than the width savings provided by omitting power supply connectors on the second end 342.

In addition to the single power supply connector 322, the print head die 338 may also include other connectors to circuitry to facilitate operation of the print head die 338. For example, the print head die 338 may include nozzle power and ground connectors (collectively referred to by 346 in FIG. 3) for connecting power and return pass to the drop ejectors 316 and signal connectors 348 for digital communication in and out from the control circuitry 344 (such as, e.g., address mode sequencing, retrieving status information, signaling which drop ejector(s) 316 to fire, etc.).

Figure 4:
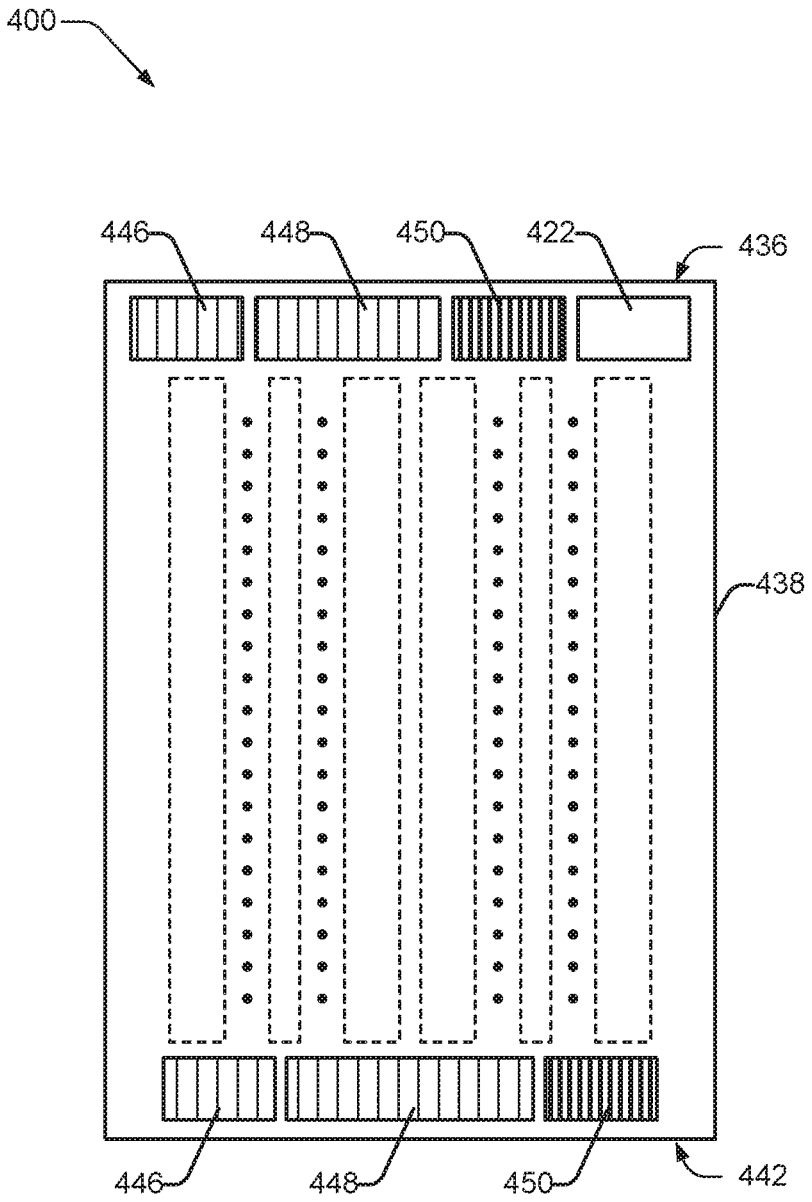
FIG. 4 is a top view of another example fluid ejection apparatus having a print head die with a single power supply connector.

The print head die 338 may also include a ground connector 350 at a second end 342, opposite the first end 336, of the print head die 338 to connect the control circuitry 344 to ground. In various implementations, the ground connector 350 may be a single ground connector for the entire print head die 338, which may allow the overall width of the print head die 338 to be reduced as compared to configurations including ground connectors on the first end 336 and the second end 342. In other implementations, however, the print head die 338 may include another ground connector at the first end 336 of the print head die 338. As illustrated in FIG. 4, for example, the fluid ejection apparatus 400 includes a print head die 438 comprising nozzle power and ground connectors 446, signal connectors 448, and a single power supply connector 422 at the first end 436 of the print head die 438, a ground connector 450 at the second end 442, and another ground connector 450 at the first end 436.

Figure 5:
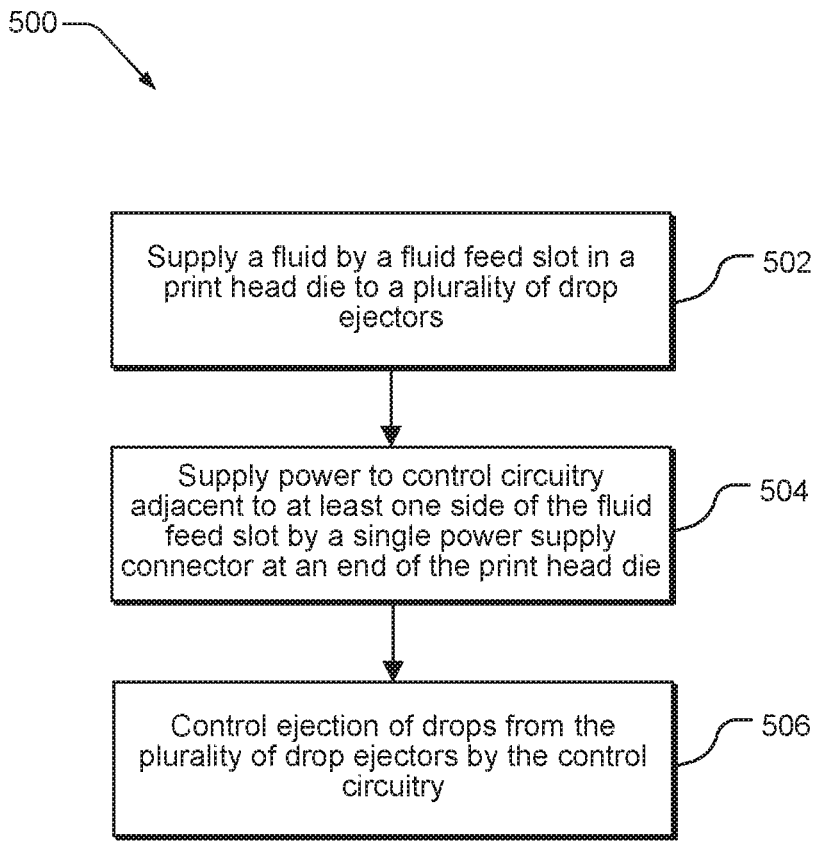
FIG. 5 is a flow diagram of an example method for operating a fluid ejection apparatus having a print head die with a single power supply connector.

FIG. 5 is a flowchart of an example method 500 related to operation of a fluid ejection apparatus with single power supply connector, in accordance with various implementations described herein. The method 500 may be associated with the various implementations described herein with reference to FIGS. 1, 2, 3, and 4, and details of the operations shown in the method 500 may be found in the related discussion of such implementations. The operations of the method 500 may be embodied as programming instructions stored on a computer/processor-readable medium, such as memory 128 described herein with reference to FIG. 1. In an implementation, the operations of the method 500 may be achieved by the reading and execution of such programming instructions by a processor, such as processor 126 described herein with reference to FIG. 1. It is noted that various operations discussed and/or illustrated may be generally referred to as multiple discrete operations in turn to help in understanding various implementations. The order of description should not be construed to imply that these operations are order dependent, unless explicitly stated. Moreover, some implementations may include more or fewer operations than may be described.

Turning now to FIG. 5, the method 500 may begin or proceed with supplying a fluid by a fluid feed slot in a print head die to a plurality of drop ejector, at block 502.

The method 500 may proceed to block 504 with supplying power to control circuitry adjacent to at least one side of the fluid feed slot by a single power supply connector at an end of the print head die. In various implementations, the method 500 may include connecting the control circuitry to ground by a ground connector at a second end, opposite the first end, of the print head die. In further implementations, the method 500 may include supplying power to another control circuitry adjacent to at least one side of another fluid feed slot in the print head die by the single power supply connector. In various ones of these implementations, the method 500 may include connecting the other control circuitry to ground by the ground connector at the second end of the print head die.

The method 500 may proceed with controlling ejection of fluid drops from the plurality of drop ejectors by the control circuitry. In various implementations, the control circuitry may control one or more actuators, such as resistive elements, heating elements, or piezoelectric elements, for example, proximate to firing chambers and drop ejectors to cause fluid to be ejected through a corresponding one of the drop ejectors.

Although certain implementations have been illustrated and described herein, it will be appreciated by those of ordinary skill in the art that a wide variety of alternate and/or equivalent implementations calculated to achieve the same purposes may be substituted for the implementations shown and described without departing from the scope of this disclosure. Those with skill in the art will readily appreciate that implementations may be implemented in a wide variety of ways. This application is intended to cover any adaptations or variations of the implementations discussed herein. It is manifestly intended, therefore, that implementations be limited only by the claims and the equivalents thereof.

What is claimed is:

1. A fluid ejection apparatus comprising:

a fluid feed structure along a length of a print head die of the fluid ejection apparatus to supply a fluid to a plurality of drop ejectors;

control circuitry adjacent to at least one side of the fluid feed structure to control ejection of drops of fluid from the plurality of drop ejectors, the control circuitry comprising logic for controlling individual or sets of the drop ejectors;

a single power supply connector at a first end of the print head die to supply power to the control circuitry; and a ground connector at a second end, opposite the first end, of the print head die to connect the control circuitry to ground.

2. The apparatus of claim 1, wherein the ground connector is a first ground connector, and wherein the fluid ejection apparatus comprises a second ground connector for the control circuitry at the first end of the print head die.

3. The apparatus of claim 1, wherein the ground connector is a single ground connector for the control circuitry.

4. The apparatus of claim 1, wherein the fluid feed structure extends between the first end and second end of the print head die.

5. The apparatus of claim 1, wherein the fluid feed structure comprises a first fluid feed slot and the plurality of drop ejectors is a first plurality of drop ejectors.

6. The apparatus of claim 5, wherein the apparatus comprises a second fluid feed slot parallel to the first fluid feed slot along the length of the print head die to supply the fluid to a second plurality of drop ejectors.

7. The apparatus of claim 6, wherein the control circuitry is first control circuitry and wherein the apparatus comprises second control circuitry adjacent to at least one side of the second fluid feed slot to control ejection of drops of fluid from the second plurality of drop ejectors.

8. The apparatus of claim 7, wherein the single power supply connector is to supply power to the second control circuitry, and wherein the ground connector is to connect the second control circuitry to ground.

9. The apparatus of claim 1, wherein the single power supply connector is disposed to one side of a set of signal connectors for the control circuitry and a set of nozzle power connectors, the single power supply connector being the only input for power from a source external to the apparatus.

10. The apparatus of claim 1, wherein the ground connector is disposed to one side of a set of signal connectors for the control circuitry and a set of nozzle ground connectors, the single ground connector being connected to the set of nozzle ground connectors and providing the only connection to ground external to the apparatus.

11. A method of operating the fluid ejection apparatus of claim 1, the method comprising:

supplying a fluid by the fluid feed structure in the print head die to the plurality of drop ejectors;

supplying power to the control circuitry adjacent to at least one side of the fluid feed structure by the single power supply connector at the first end of the print head die; and controlling ejection of drops from the plurality of drop ejectors by the control circuitry.

12. The method of claim 11, wherein the method further comprises connecting the control circuitry to ground by a ground connector at a second end, opposite the first end, of the print head die.

13. The method of claim 11, further comprising supplying power to another control circuitry adjacent to at least one side of another fluid feed structure in the print head die by the single power supply connector.

14. A fluid ejection apparatus comprising a printhead die; and a fluid feed slot to a first plurality of drop ejectors and a second plurality of drop ejectors;

the printhead die comprising:

first control circuitry adjacent to at least one side of the first fluid feed slot to control ejection of drops of fluid from the first plurality of drop ejectors, and second control circuitry adjacent to at least one side of the second fluid feed slot to control ejection of drops of fluid from the second plurality of drop ejectors; and a single power supply connector adjacent to an end of the plurality of fluid feed slots to supply power to the first control circuitry and the second control circuitry, the single power supply connector disposed in a corner of the printhead die.

15. The apparatus of claim 14, wherein the fluid feed slot comprises a plurality of fluid feed slots including a first fluid feed slot to supply a fluid to the first plurality of drop ejectors and a second fluid feed slot to supply the fluid to the second plurality of drop ejectors.

16. The apparatus of claim 15, wherein the end is a first end, and wherein the apparatus further comprises a ground connector adjacent to a second end, opposite the first end, of the plurality of fluid feed slots to connect the first control circuitry and the second control circuitry to ground, the ground connector disposed in a second corner of the printhead die.

17. The apparatus of claim 16, wherein the second corner is on a same side of the printhead die as the corner at which is disposed the single power supply connector.

18. The apparatus of claim 16, wherein the ground connector is a single ground connector to connect the first control circuitry and the second control circuitry to ground.

19. The apparatus of claim 14, wherein the end is a first end and wherein the apparatus is devoid of power supply connectors adjacent to a second end, opposite the first end, of the plurality of fluid feed slots.

20. A fluid ejection apparatus comprising:

a fluid feed structure along a length of a print head die of the fluid ejection apparatus to supply a fluid to a plurality of drop ejectors;

control circuitry adjacent to at least one side of the fluid feed structure to control ejection of drops of fluid from the plurality of drop ejectors, the control circuitry comprising logic for controlling individual or sets of the drop ejectors;

a single power supply connector at a first end of the print head die to supply power to the control circuitry; and a ground connector at both the first end and a second end, opposite the first end, of the print head die to connect the control circuitry to ground.

* * * * *